US006532609B2

(12) United States Patent
Taylor et al.

(10) Patent No.: US 6,532,609 B2
(45) Date of Patent: Mar. 18, 2003

(54) PHYSIOTHERAPY BENCH

(75) Inventors: Robert Taylor, Bolingey (GB); Peter Herman, Nr. Newquay (GB)

(73) Assignee: Gainsborough Accessories International Limited, Cornwall (GB)

( * ) Notice: Subject to any disclaimer, the term of this patent is extended or adjusted under 35 U.S.C. 154(b) by 0 days.

(21) Appl. No.: 09/940,496

(22) Filed: Aug. 29, 2001

(65) Prior Publication Data

US 2002/0095182 A1 Jul. 18, 2002

Related U.S. Application Data

(60) Provisional application No. 60/229,046, filed on Aug. 31, 2000.

(30) Foreign Application Priority Data

Aug. 30, 2000 (CA) ..... 2317156

(51) Int. Cl.[7] ..... A47B 7/00; A47B 7/02

(52) U.S. Cl. ..... 5/613; 5/620; 5/621; 5/622; 5/623; 5/624; 601/49; 601/24; 108/29

(58) Field of Search ..... 108/129; 5/613, 5/620, 621, 622, 623, 624, 731, 734, 735; 601/49, 24

(56) References Cited

U.S. PATENT DOCUMENTS 861,868 A * 7/1907 Lewis ..... 5/613
3,042,025 A * 7/1962 Jackson ..... 5/632
3,266,061 A * 8/1966 Fuechsel ..... 5/600
3,599,964 A * 8/1971 Magni ..... 5/624
3,639,927 A * 2/1972 Munch ..... 5/648
3,747,916 A * 7/1973 Benson ..... 5/600
4,207,635 A * 6/1980 Leroy ..... 482/142
4,275,472 A * 6/1981 Erck ..... 5/111
4,398,707 A * 8/1983 Cloward ..... 269/328
4,647,108 A * 3/1987 Hayashi ..... 297/391
5,001,739 A * 3/1991 Fischer ..... 378/195
5,427,436 A * 6/1995 Lloyd ..... 297/408
5,893,183 A * 4/1999 Bechtold, Jr. ..... 5/632
D433,508 S * 11/2000 Crowther et al. ..... D24/183
6,151,734 A * 11/2000 Lawrie ..... 5/622
6,154,903 A * 12/2000 Wai-Chung ..... 5/632

* cited by examiner

*Primary Examiner*—J. J. Swann
*Assistant Examiner*—Katherine W Mitchell
(74) *Attorney, Agent, or Firm*—Finnegan, Henderson, Farabow, Garrett & Dunner L.L.P.

(57) ABSTRACT

A physiotherapy bench includes a frame supported by legs in an elevated, use position, and an arcuate body supporting panel on the frame. The supporting panel includes a substantially horizontal front end for supporting the chest of a patient, and an inclined rear end for supporting the hips and the upper portion of the legs of a patient, whereby the spine is subjected to gentle traction. A headrest is resiliently connected to the front end of the frame for floating support of the head of a patient.

13 Claims, 9 Drawing Sheets

PHYSIOTHERAPY BENCH

CROSS REFERENCE TO RELATED APPLICATIONS

This application claims priority under 35 U.S.C. §119 based on Canadian Application No. 2,317,156, filed Aug. 30, 2000, and on U.S. Provisional Application No. 60/229,046, filed Aug. 31, 2000, the complete disclosures of both are incorporated by reference.

BACKGROUND OF THE INVENTION

This invention relates to a physiotherapy bench.

People suffering from back pain and in particular lower back pain, sometimes require physiotherapy treatment. Such treatment is usually carried out while the patient lies in a prone position on a horizontal physiotherapy bench having a flat supporting panel. It has been found that a flat surface causes the spine joints in the lower back to undergo compression when the patient is in the prone position. Compression of the spine can increase a patient's discomfort and make treatment difficult. Back pain is best treated when the spine is in an uncompressed or "neutral" position.

Similarly, the placing of the patient's neck joints in a neutral position during treatment is desirable. A flat support surface also causes the neck to be compressed when the patient is in the prone position on the physiotherapy bench. Even when the bench includes a separate headrest, the headrest must be properly adjusted to avoid compression of the patient's neck.

Physiotherapy support panels are usually horizontal and elevated above the floor. Many patients have difficulty getting onto a raised horizontal bench and positioning themselves in the prone position thereon without twisting their spine. This is a serious problem, because such twisting can cause additional back pain.

Many conventional physiotherapy benches do not have sufficient leg room below the support panel to permit a physiotherapist to work close to the patient. This results in the physiotherapist having to reach to treat the patient. The more a physiotherapist must reach during treatment, the greater the risk of the physiotherapist suffering back injury.

Physiotherapy benches are not usually available for home treatment, and it is necessary to improvise, using a flat surface such as a bed or table. An improvised bench of this nature has the disadvantage that the patient will not likely be supported at a height convenient and comfortable to the physiotherapist. This can result in the physiotherapist developing a backache during prolonged treatment.

SUMMARY OF THE INVENTION

The object of the present invention is to provide a physiotherapy bench, which solves the problems involved with conventional physiotherapy benches discussed above, supports a patient's neck and spine in the neutral position, and is adjustable and portable to suit the requirements of both patient and physiotherapist.

The advantages and purpose of the invention will be set forth in part in the description which follows, and in part will be obvious from the description, or may be learned by practice of the invention. The advantages and purpose of the invention will be realized and attained by means of the elements and combinations particularly pointed out in the appended claims.

To attain the advantages and in accordance with the purpose of the invention, as embodied and broadly described herein, the invention relates to a physiotherapy bench comprising a frame, an arcuate supporting panel on said frame, legs for supporting the panel and frame in an elevated use position in which the supporting panel provides a substantially horizontal front end for supporting the chest of a patient and an inclined rear end for supporting the hips and the upper portion of the legs of a patient, and a headrest connected to said frame at said front end for supporting the head of a patient.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate an embodiment of the invention and together with the description, serve to explain the principles of the invention. In the drawings.

DESCRIPTION OF THE PREFERRED EMBODIMENT

Reference will now be made in detail to the present preferred embodiment of the invention, an example of which is illustrated in the accompanying drawings. Wherever possible, the same reference numbers will be used throughout the drawings to refer to the same or like parts.

In accordance with the present invention, a physiotherapy bench is provided with a frame, an arcuate supporting panel on the frame, legs for supporting the panel and frame in an elevated use position in which the supporting panel provides a substantially horizontal front end for supporting the chest of a patient and an inclined rear end for supporting the hips and the upper portion of the legs of a patient; and a headrest connected to the frame at the front end for supporting the head of a patient.

Figure 1:
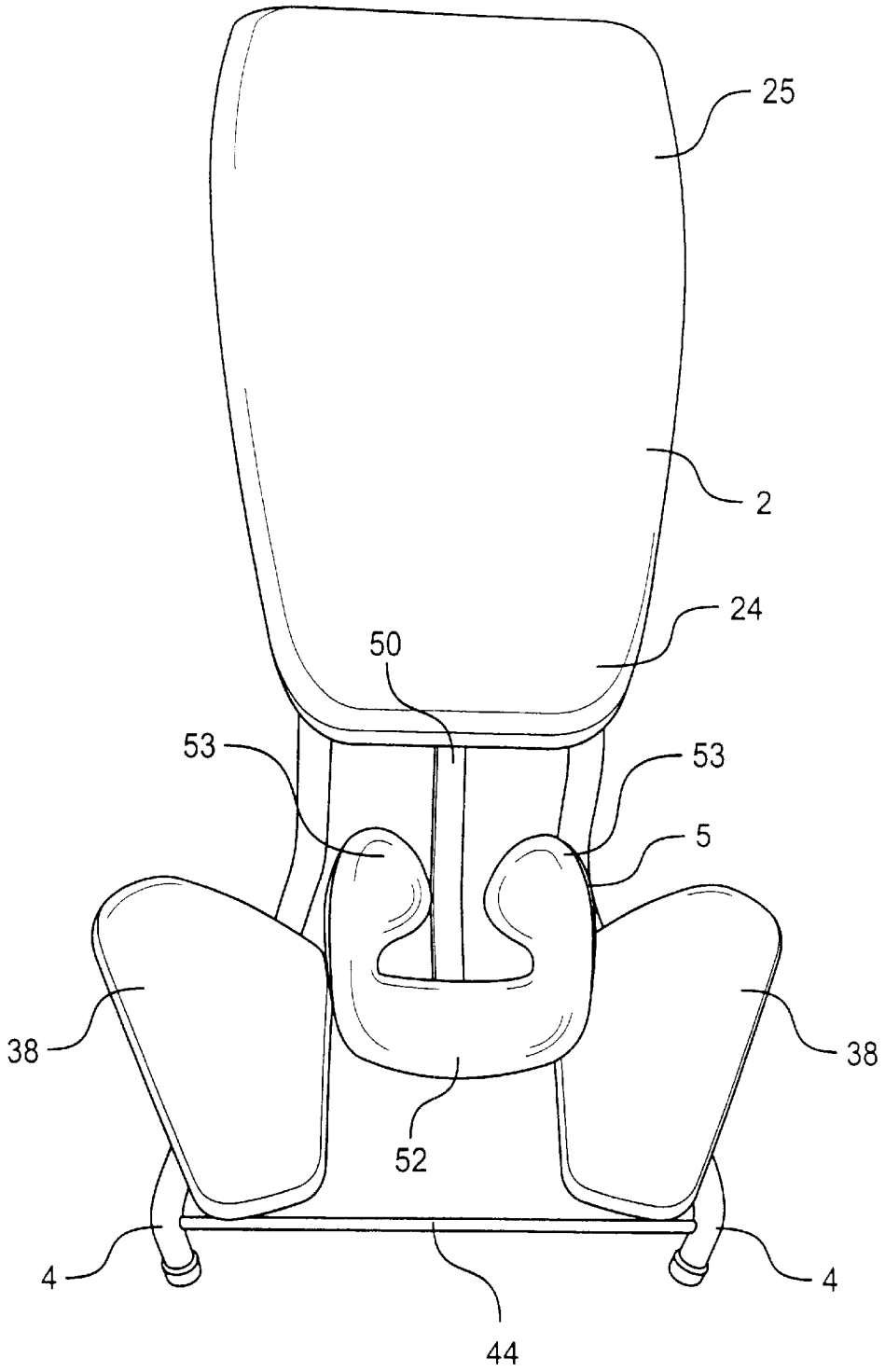
FIG. 1 is a top view of a physiotherapy bench in accordance with the present invention.
Figure 2:
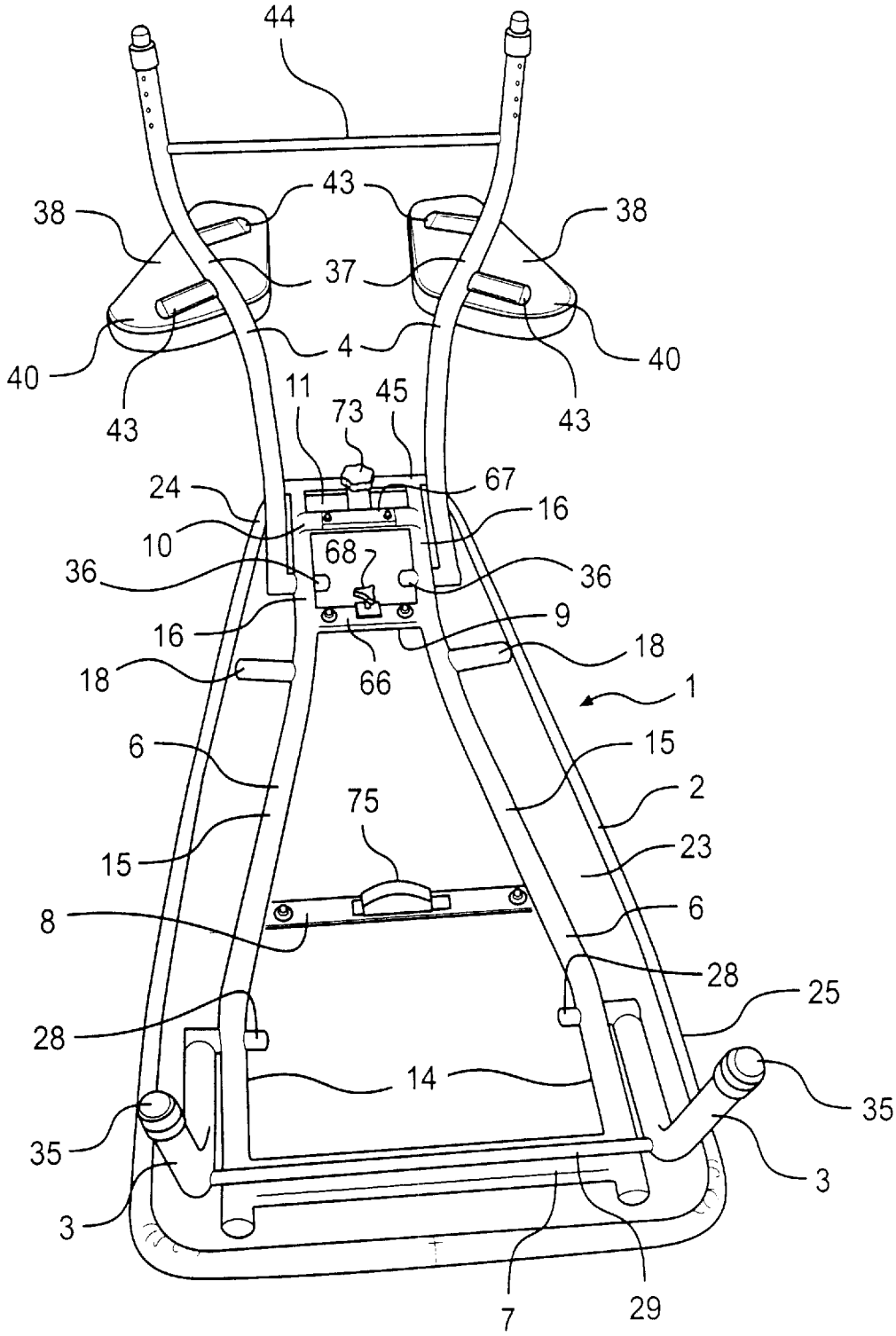
FIG. 2 is a perspective view of the bottom of the bench of FIG. 1 with parts omitted.

In the illustrated embodiment, as shown in FIGS. 1 and 2, the physiotherapy bench includes a skeletal frame generally indicated at 1, a panel 2 mounted on the frame 1 for supporting the body of a patient, rear legs 3 and front legs 4 for supporting the frame 1 in an elevated position, and a headrest 5 for supporting the head of a patient.

As best shown in FIG. 2, the support frame 1 is defined by a pair of tubular sides 6 interconnected by crossbars 7, 8, 9, 10, and 11. The sides of the frame include straight, parallel rear sections 14, forwardly converging middle sections 15, and straight parallel front sections 16. Short arms 18 extend outwardly from the front ends of the middle sections 15 for supporting the sides of the panel 2.

Figure 4:
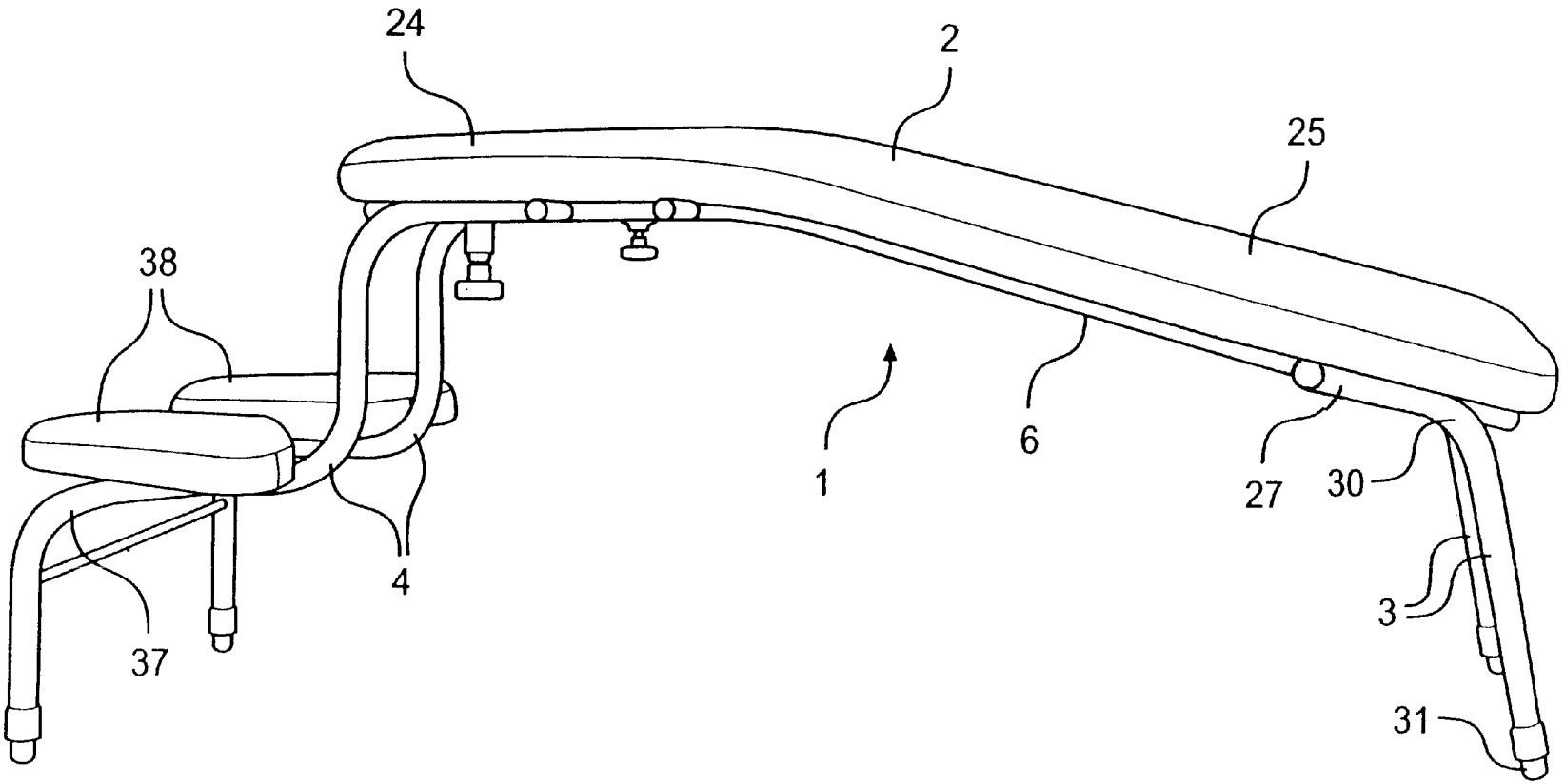
FIG. 4 is a side view of the bench of FIG. 1 with parts omitted.
Figure 5:
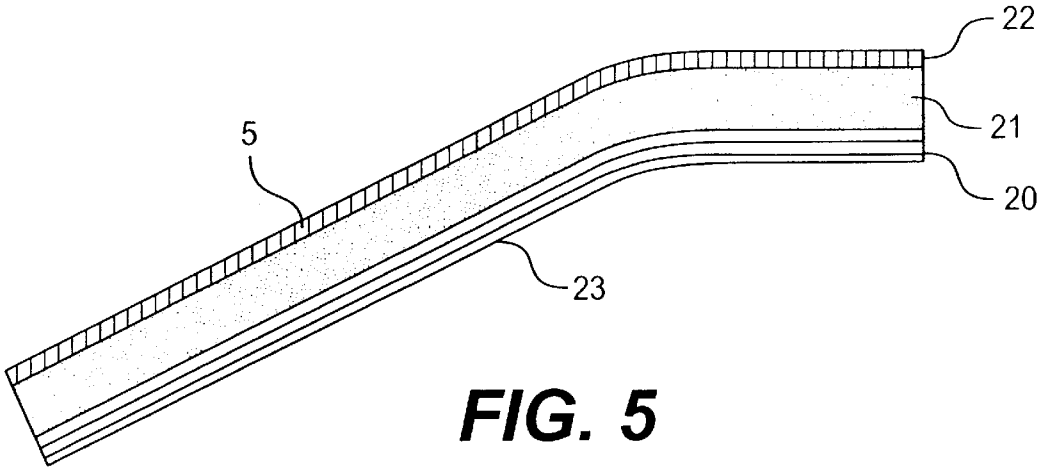
FIG. 5 is a schematic longitudinal section view of a panel used in the bench of FIGS. 1 to 4.

The frame 1 carries the panel 2 which is defined by a laminated plywood base 20 (FIG. 5), a foam pad 21 on the base 20 and a plastic, fabric or leather cover 22 extending around the top, sides and ends of the panel. A strip 23 (FIG. 2) of carpet material covers the bottom of the panel 2. The front and rear ends of the panel 2 are straight, and the sides taper from the rear to the front end thereof. A narrow front section 24 of the panel 2 is intended to support the chest of a patient, while a wider rear portion 25 is intended to support the hips and top ends of the legs of the patient. The use of laminated plywood to form the base 20 of the panel 2 permits bending of the panel during production whereby the finished panel is curved, the front end being substantially horizontal in the use position and the rear end being inclined downwardly from the front end. The angle between the planes of the front and rear portions 24 and 25 is 16°. Referring to FIGS. 2 and 4, it will be noted that the sides 6 of the frame 1 are substantially coextensive with the panel 2 and are bent in the same manner as the panel 2 for supporting the panel along the entire length thereof.

The frame 1 and consequently the panel 2 are supported in an elevated use position by the rear and front legs 3 and 4, respectively. The rear legs 3 are generally chevron-shaped, one arm 27 thereof being parallel to the rear end of the side 6 of the frame 1 in the erect position. The free end of each arm 27 is pivotally connected to one frame side 6 by a pin 28 (FIG. 2) extending inwardly from such free end. A crossbar 29 interconnects the legs 3 at their elbows 30. The rear legs 3 are telescopic. For such purpose, a foot 31 is slidably mounted in the bottom free end of each rear leg 3. The foot is retained in one of a plurality of positions by a generally U-shaped spring clip, and buttons (not shown) on the ends of the clip for engaging holes 33 in the rear legs 3. Plastic glides 35 are provided on the bottom free ends of the rear legs 3.

Figure 3:
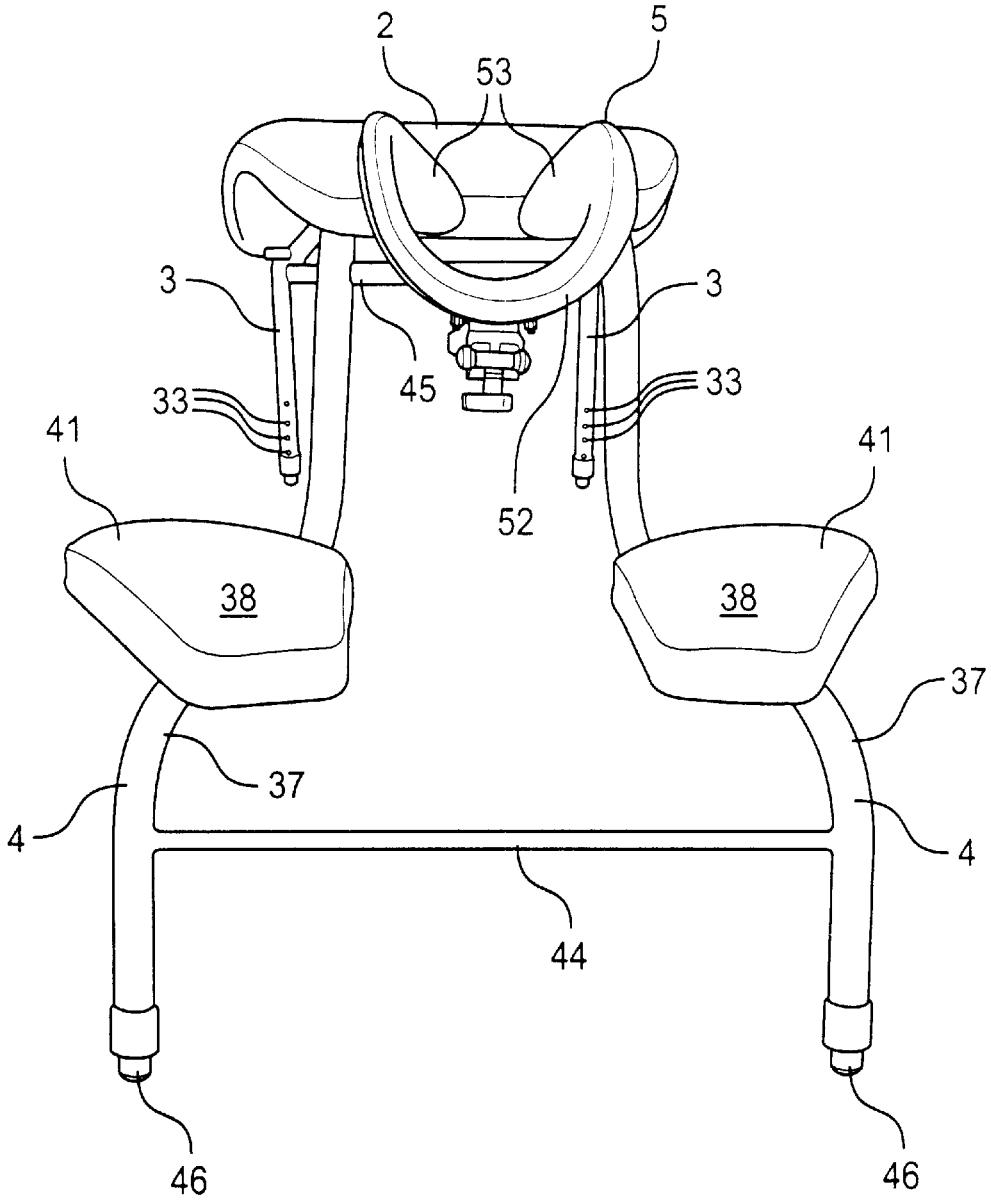
FIG. 3 is a front view of the bench of FIG. 1.
Figure 6:
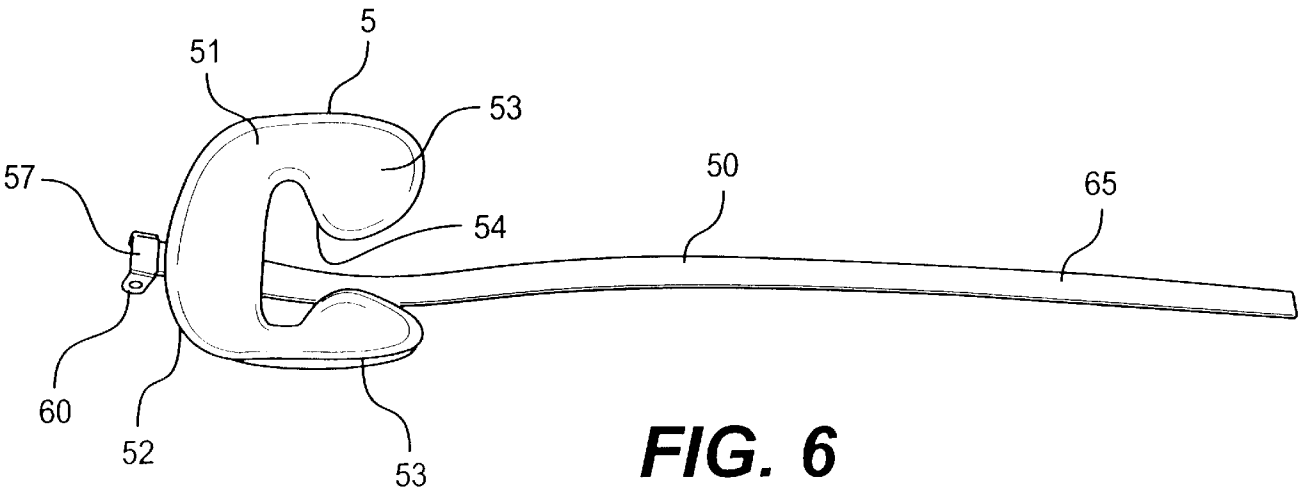
FIG. 6 is a perspective view of a headrest used in the bench of FIGS. 1 to 4.
Figure 7:
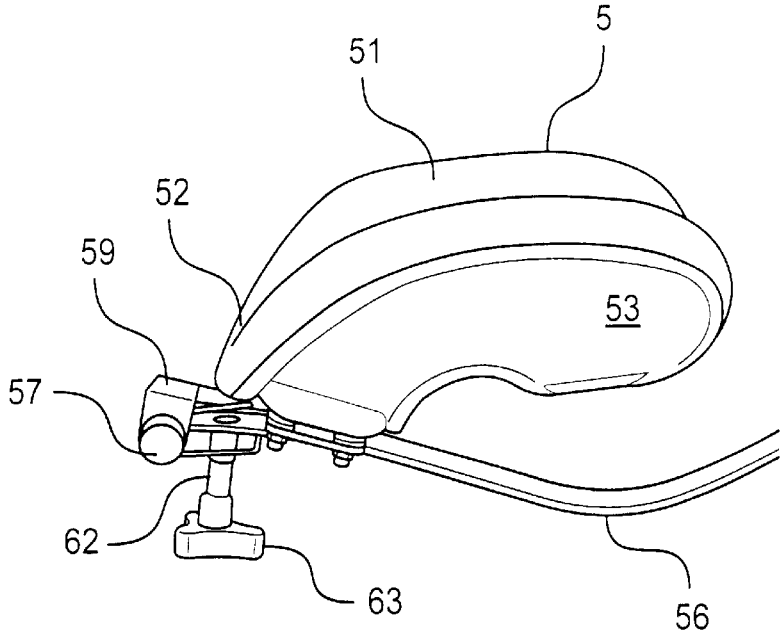
FIGS. 7 and 8 are perspective views of the headrest of FIG. 6 in two positions.
Figure 8:
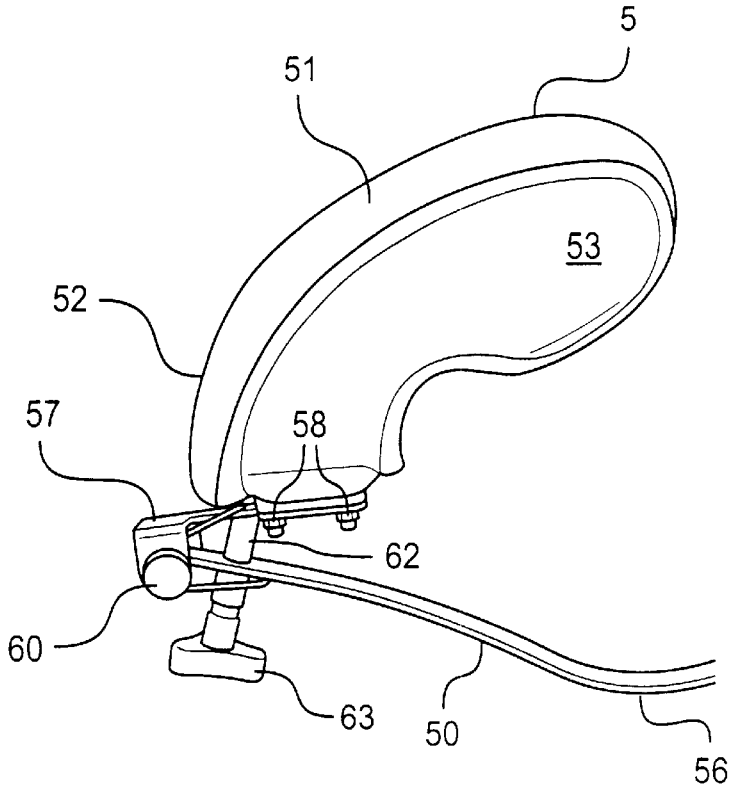
Figure 9:
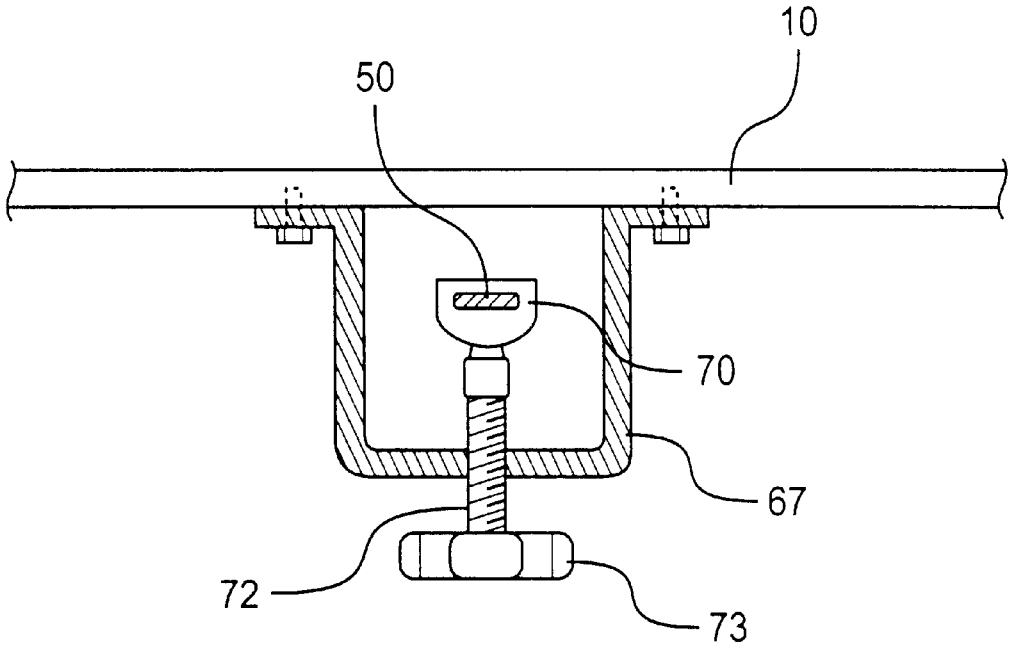
FIG. 9 is a schematic cross-sectional view of a headrest mounting bracket used in the bench of FIGS. 1 to 4.

Each of the front legs 4 is also pivotally connected to the frame sides 6 by pins 36 (FIG. 2) extending inwardly from the top free ends of the front legs 4. The front legs 4 include steps 37 for supporting arm rests 38. The arm rests 38 are similar in structure to the panel 2 including a solid base 40, a foam pad (not shown) and a cover 41. Arms 43 extending outwardly from the steps 37 provide additional support for the arm rests 38. Crossbars 44 and 45 extend between the front legs 4 beneath the steps 37 and at the top of the front legs, respectively for maintaining the legs spaced apart the appropriate distance, and for causing the front legs 4 to move together from a folded (FIG. 6) to an extended or erect position (FIGS. 3 and 4).

Like the rear legs 3, the front legs 4 are also telescopic, including feet 46 extending downwardly from the bottom ends thereof. The feet 46 of front legs 4 can be latched in one position in the same manner as the rear legs 3.

In accordance with the invention, the headrest includes a leaf spring resiliently connecting the headrest to the front end of the frame, and is pivotally connected to the spring to permit adjustment of the orientation of the headrest relative to the spring. A first bracket adjustably connects the spring to the frame, permitting adjustment of the spacing of the headrest with respect to the support panel, and a second bracket releasably connects the spring to the frame, whereby the headrest can be separated from the frame. Also, the headrest includes a U-shaped body having a concave front end for supporting the forehead of a patient, and a pair of acuate wings extending upwardly and rearwardly from the front end for supporting the cheeks of a patient's head.

In the illustrated embodiment and as shown in FIGS. 6 to 9, the headrest 5 for supporting a patient's head is connected to the front end of the frame 1 by an elongated leaf spring 50, so that the patient's head literally floats with the headrest during physiotherapy. The headrest 5 includes a padded, generally U-shaped body 51 with a concave front end 52 for supporting the forehead of a patient. Arcuate arms 53 extend upwardly and rearwardly from the front end for supporting the cheeks of the patient's head. A generally keyhole-shaped opening 54 (FIG. 6) in the bottom of the headrest 5 receives the nose and mouth of the patient, so that breathing is not restricted.

The leaf spring 50 is an elongated strip of steel with a concave outer front end 56, which is connected to the body 51 by a bracket 57. The bracket 57 is connected to the body 51 by bolts 58, and the outer end of the spring 56 carries a pin 60 extending through the arms of an inverted U-shaped outer end of the bracket 57. A bolt 60 extending through the spring 50 engages the bottom of the body 51. By manually rotating the bolt 62 using a knob. 63 on the bottom free end thereof, the body 51 is rotated around the longitudinal axis of the pin 60 to change the inclination of the headrest 5 with respect to the panel 2 and the spring 56.

Figure 10:
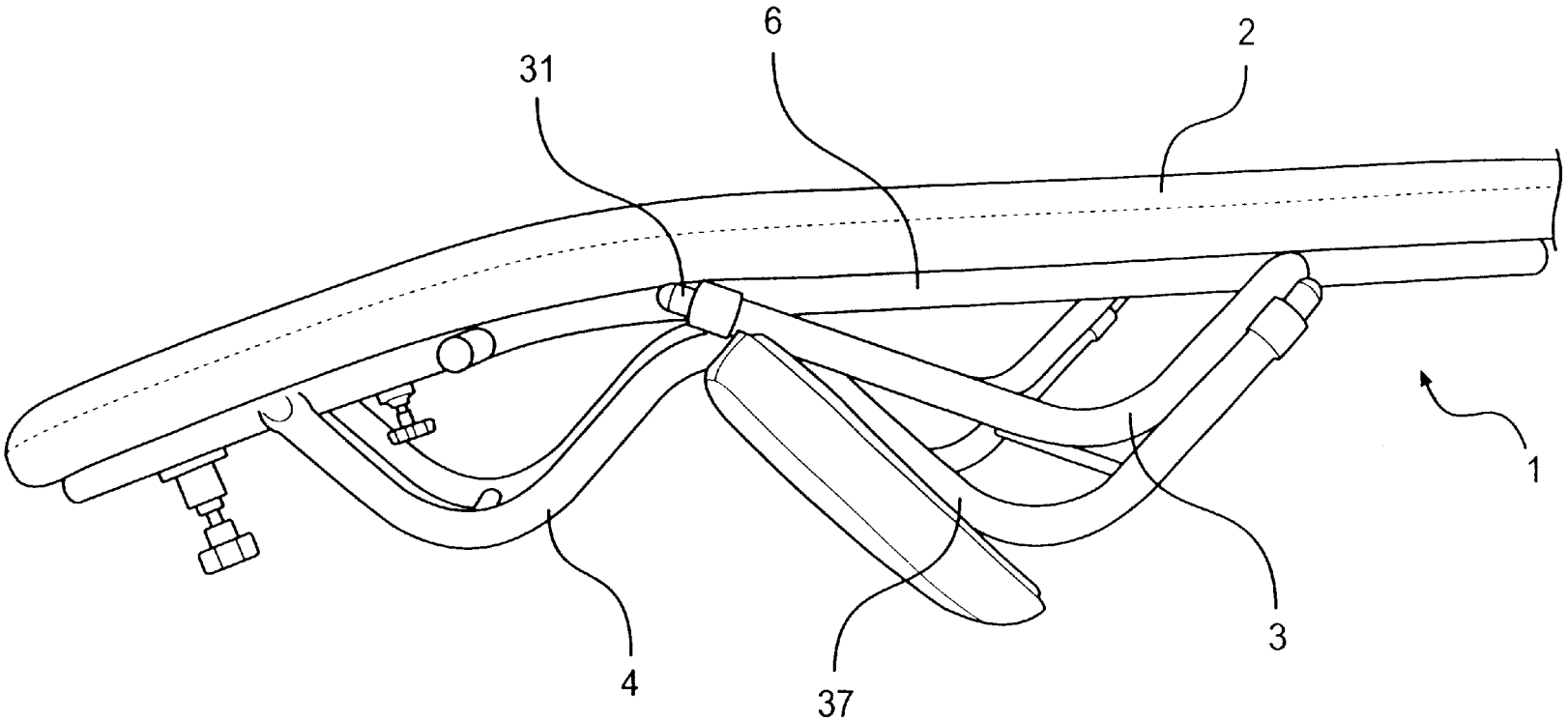
FIG. 10 is a side view of all but one end of the bench of FIG. 1 in the collapsed condition.

The inner or rear end 65 of the spring 50 is slightly arcuate, and is connected to the frame 1 beneath the panel 2. The spring 50 extends through a pair of generally U-shaped brackets 66 and 67 (FIG. 2), which are connected to the bottoms of the crossbars 9 and 10, respectively. By tightening a bolt (not shown) in the rear bracket 66 using a knob 68, the spring is locked in one position, i.e. is prevented from moving longitudinally in the bracket 66 relative to the frame 1. As shown in FIG. 10, the bracket 67 is high enough that the spring 50 can move vertically therein. The spring 50 extends through a swivel head 70 on the top end of a bolt 72 in the bracket 67. By manually adjusting the bolt 72 using a knob 73, the height of the spring 50 and consequently the headrest 5 are changed. Thus, the height of the headrest 5 and the spacing of the headrest from the front end of the panel 2 can readily be adjusted.

Figure 11:
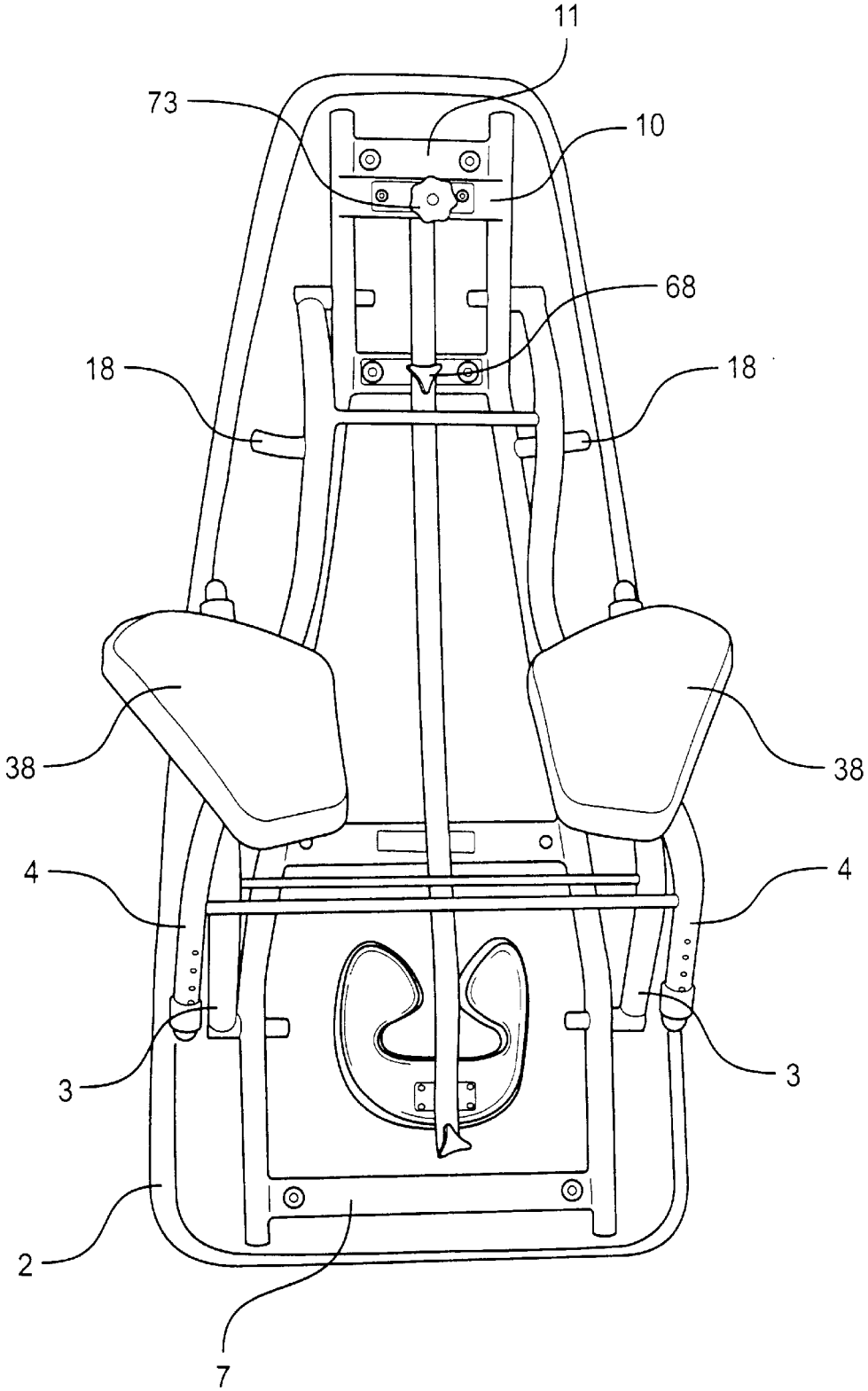
FIG. 11 is a bottom view of the bench of FIG. 1 in the collapsed condition.

Referring to FIGS. 10 and 11, when the bench is not in use, i.e. in the storage or transport condition, the spring 50 is removed from the brackets 66 and 67, and the headrest 5 is reversed and stored under the panel 2. In such condition, the spring 50 is retained by a hook and loop type fastener strip 75 (FIG. 2) of a type designated by the trade mark VELCRO™ on the crossbar 10, and which extends through the bracket 66 into the bracket 67. The knob 68 is rotated to clamp the spring 50 in the storage position. The rear legs 3 are folded forwardly, and the front legs 4 are folded rearwardly into overlapping relationship with the rear legs 3 to form a compact assembly.

In the erect, use position of the bench, the front and rear legs 3 and 4 are slightly inclined. The length of the legs and the position of the headrest 5 are adjusted to suit the patient. The inclined rear portion 25 of the panel 2 permits the patient to crawl onto the bench. With a patient prone on the bench, the head of the patient is above his or her feet. The arcuate shape of the top of the panel 2 causes stretching of the spine, facilitating physiotherapy on the patient's back. The curved top of the bench causes a natural, gentle traction. A heavy patient will cause the legs 3 and 4 to flex slightly. The taller the patient, the more his or her legs dangle over the rear end of the panel 5 and the greater the traction. As mentioned above, the elongated leaf spring 50 supporting the headrest 5 in spaced apart relationship to the panel 2, gives the patient the impression that his or her head is floating, while the body is fully supported by the panel 2. When the position of the headrest 5 is correctly adjusted, the patient's neck is in gentle traction. With a conventional bench, the neck is in compression.

Because the bench 2 is narrower in the area of the patient's spine, and the legs 3 and 4 are inclined outwardly from the frame 1, a therapist can get closer to the patient than with existing benches. This prevents therapist back strain, provides a relatively comfortable working position and improves technique.

What is claimed is:

1. A physiotherapy bench comprising:

a frame having a side profile defining a substantially horizontal front portion joined by a curved portion to a downwardly inclined rear portion;

a curved supporting panel on said frame;

legs for supporting said panel and frame in an elevated use position in which said supporting panel provides a substantially horizontal front end for supporting the chest of a patient and a downwardly inclined rear end for supporting the hips and the upper portion of the legs of a patient; and a headrest connected to said frame at said front end for supporting the head of a patient.

2. A physiotherapy bench according to claim 1, wherein said headrest includes a leaf spring resiliently connecting said headrest to said front end of said frame.

3. A physiotherapy according to claim 1 or 2, wherein said legs include front and rear legs pivotally connected to said frame for rotation between an extended use position and a folded storage position beneath said frame.

4. A physiotherapy bench according to claim 3, including arm rests on said front legs.

5. A physiotherapy bench according to claim 2, including a first bracket adjustably connecting said spring to said frame, permitting adjustment of the spacing of said headrest with respect to said support panel.

6. A physiotherapy bench according to claim 5 or 7, including a second bracket for releasably connecting said spring to said frame, whereby said headrest can be separated from said frame.

7. A physiotherapy bench according to claim 2, wherein said headrest is pivotally connected to said spring to permit adjustment of the orientation of said headrest relative to said spring.

8. A physiotherapy bench according to any of claim 1 or 2, wherein said supporting panel includes a narrow front portion for supporting the chest of a patient and a wide rear portion for supporting the hips and part of the legs of a patient.

9. A physiotherapy bench according to claim 8, wherein the supporting panel tapers forwardly from said wide rear portion to said narrow front portion.

10. A physiotherapy bench according to any of claim 1 or 2, wherein said headrest includes a U-shaped body having a concave front end for supporting the forehead of a patient, and a pair of arcuate wings extending upwardly and rearwardly from said front end for supporting the cheeks of a patient's head.

11. A physiotherapy bench according to claim 1, wherein said frame is skeletal.

12. A physiotherapy bench comprising:

a frame;

an arcuate supporting panel on said frame;

legs for supporting said panel and frame in an elevated use position in which said supporting panel provides a substantially horizontal front end for supporting the chest of a patient and an inclined rear end for supporting the hips and the upper portion of the legs of a patient;

a headrest connected to said frame at said front end for supporting the head of a patient;

said legs including front and rear legs pivotally connected to said frame for rotation between an extended use position and a folded storage position beneath said frame;

arm rests on said front legs; and each of said front legs including a ledge carrying one of said arm rests.

13. A physiotherapy bench according to claim 12, wherein said headrest includes a leaf spring resiliently connecting said headrest to said front end of said frame.

* * * * *

UNITED STATES PATENT AND TRADEMARK OFFICE

CERTIFICATE OF CORRECTION

PATENT NO. : 6,532,609 B2
DATED : March 18, 2003
INVENTOR(S) : Robert Talyor and Peter Herman It is certified that error appears in the above-identified patent and that said Letters Patent is hereby corrected as shown below:

Column 5,
Line 33, after “physiotherapy”, insert -- bench --.

Column 6,
Lines 5 and 13, “claim” should read -- claims --.

Signed and Sealed this

Sixth Day of May, 2003

JAMES E. ROGAN
*Director of the United States Patent and Trademark Office*